US005191820A

United States Patent [19]

Hartmann

[11] Patent Number: 5,191,820

[45] Date of Patent: Mar. 9, 1993

[54] FEED DRIVE FOR A CUTTING MACHINE FOR CUTTING FOODS

[75] Inventor: Franz Hartmann, Simmerberg, Fed. Rep. of Germany

[73] Assignee: Natec, Reich, Summer GmbH & Co. KG, Fed. Rep. of Germany

[21] Appl. No.: 717,984

[22] Filed: Jun. 20, 1991

[30] Foreign Application Priority Data

Apr. 16, 1991 [DE] Fed. Rep. of Germany ... 9104588[U]

[51] Int. Cl.[5] ..... B26D 7/06

[52] U.S. Cl. ..... 83/409; 83/277; 83/418; 83/422; 83/423; 83/436; 83/437

[58] Field of Search ..... 83/409, 436, 422, 423, 83/703, 418, 453, 206, 277, 437, 676

[56] References Cited

U.S. PATENT DOCUMENTS

| | | | |
|---|---|---|---|
| 1,445,521 | 2/1923 | Luschka et al. | 83/676 X |
| 1,837,014 | 12/1931 | Campbell | 83/418 X |
| 1,995,048 | 3/1935 | Walter | 83/422 |
| 3,200,865 | 8/1965 | Garapolo | 83/423 |
| 4,329,900 | 5/1982 | Dennis et al. | 83/422 X |
| 4,583,435 | 4/1986 | Fessler | 83/90 |

*Primary Examiner*—Douglas D. Watts
*Assistant Examiner*—Raymond D. Woods
*Attorney, Agent, or Firm*—Brown, Martin, Haller & McClain

[57] ABSTRACT

A feed drive for a cutting machine for cutting foods consists of a claw which penetrates into the product at the rear face of the product to be sliced whereby the claw is driven intermittently or continuously in the direction of feed, and guides the product on a roller conveyor against a cutting device so that slices are cut from the product. For an improved guidance of the product and in order to avoid inconsistent slices in particular in products which are long and whose consistency is soft, there is another force-locking and form-locking drive for the product at the front end of the product in the vicinity of the circular knife of the cutting device coupled with the drive of the claw. This additional drive consists at least of a feed roller which engages the bottom of the product in a force-locking and form-locking fashion and which is driven as a function of the feed path of the claw.

9 Claims, 2 Drawing Sheets

FEED DRIVE FOR A CUTTING MACHINE FOR CUTTING FOODS

BACKGROUND OF THE INVENTION

The present invention concerns a feed device in accordance with the introductory part of patent claim 1. Such a feed device has become known (DE 32 49 925 C2) in that for the purpose of cutting foods, in particular sausage and cheese, such a product is placed on a roller conveyor whereby the roller conveyor is slanted downward in the direction of a circular knife which interacts with a fixed counterknife.

At the rear end, the product is caught by a so-called claw consisting of an intermittently driven housing whose front end features mechanical claws which catch the rear face of the product and hold it. When viewed in the longitudinal direction of the product, the claw is driven intermittently or continuously by a drive so that with each advance of the claw the product is moved along over a certain distance on the roller conveyor against the circular knife so that a slice of a specific thickness is cut from the product.

Such cutting machines process products with a length of up to 1.20 m. When handling such long products, in particular when these products feature a relatively soft consistency, there is the disadvantage that when the product is driven intermittently on the roller conveyor towards the circular knife the product has a tendency to swing thus resulting in inconsistent slice thickness.

In other words there are undesirable product swings due to the intermittent feed drive of this product against the circular knife resulting in the inconsistent slices described above.

SUMMARY OF THE INVENTION

The purpose of the present invention therefore is to design the feed drive of a cutting machine of the type described earlier so that slices of equal thickness can be cut from products even if they are long and relatively soft.

In order to accomplish this task, and coupled with the drive of the claw, the invention features another force-locking and form-locking drive for the product at the front end of the product in the vicinity of the circular knife and which consists at least of one feed roller which engages the bottom of the product in a force-locking and form-locking manner and which is driven in a rotating fashion as a function of the feed path of the claw.

In other words, an essential feature of the present invention is the fact that coupled with the drive of the claw which engages only at the rear end of the product, there is another drive for the product in the direction of feed at the front end of the product next to the circular knife whereby this drive is coupled in a form-locking fashion to the drive of the claw. The feed roller may be situated at the end of the roller conveyor just before the circular knife; but it may also be located in the roller conveyor and catch through the rollers of the roller conveyor.

Preferably, the force-locking and form-locking drive in the vicinity of the circular knife which engages the bottom of the product is designed in a preferred embodiment as feed roller which preferably features teeth at its outer perimeter and which engage the bottom of the product.

The teeth are chosen in such a manner that the respective tooth marks correspond with the subsequently cut slices so that such tooth marks are no longer visible in the sliced product.

In a preferred embodiment of the invention, the drive of the feed roller is coupled to the claw drive so that the torsion-tested feed roller is connected to a drive gear over which runs a ratchet belt which is led over a guide roller as a closed strap. This ratchet belt is now coupled directly to the claw via a clamp so that a corresponding drive of the claw engages the ratchet belt, which drives the feed roller via the drive gear in the direction of feed.

The advantage of this invention is that the feed roller no longer requires its own drive motor and that it produces an absolutely synchronous drive between the claw and the feed roller.

In another embodiment of the present invention however, the feed roller features its own drive which is synchronized with the drive of the claw.

The state of the art described above offers the significant advantage that the product is now driven at practically two ends, i.e. at its rear end and at its end next to the circular knife. As a result, the product is stabilized between these two absolutely synchronous drives and therefore no longer tends to swing even when products are used whose consistency is relatively soft. This makes it possible for the first time to achieve an absolutely uniform cut even when product lengths are very significant and products are very soft so that a uniform slice value is achieved when cutting with the circular knife, even with products which are difficult to handle.

The object of this invention derives not only from the object of the individual patent claims but also from the combination of the individual patent claims among each other. All data and characteristics described in the documentation, including the summary, in particular the design as illustrated in the drawings, are claimed as essential to the invention to the extent that jointly or separately they are new in terms of the state of the art.

BRIEF DESCRIPTION OF THE DRAWINGS

The following is a more detailed description of the invention through drawings which illustrate only one variant. These drawings and their description illustrate further characteristics and advantages of the present invention.

DESCRIPTION OF THE PREFERRED EMBODIMENT(S)

Figure 1:
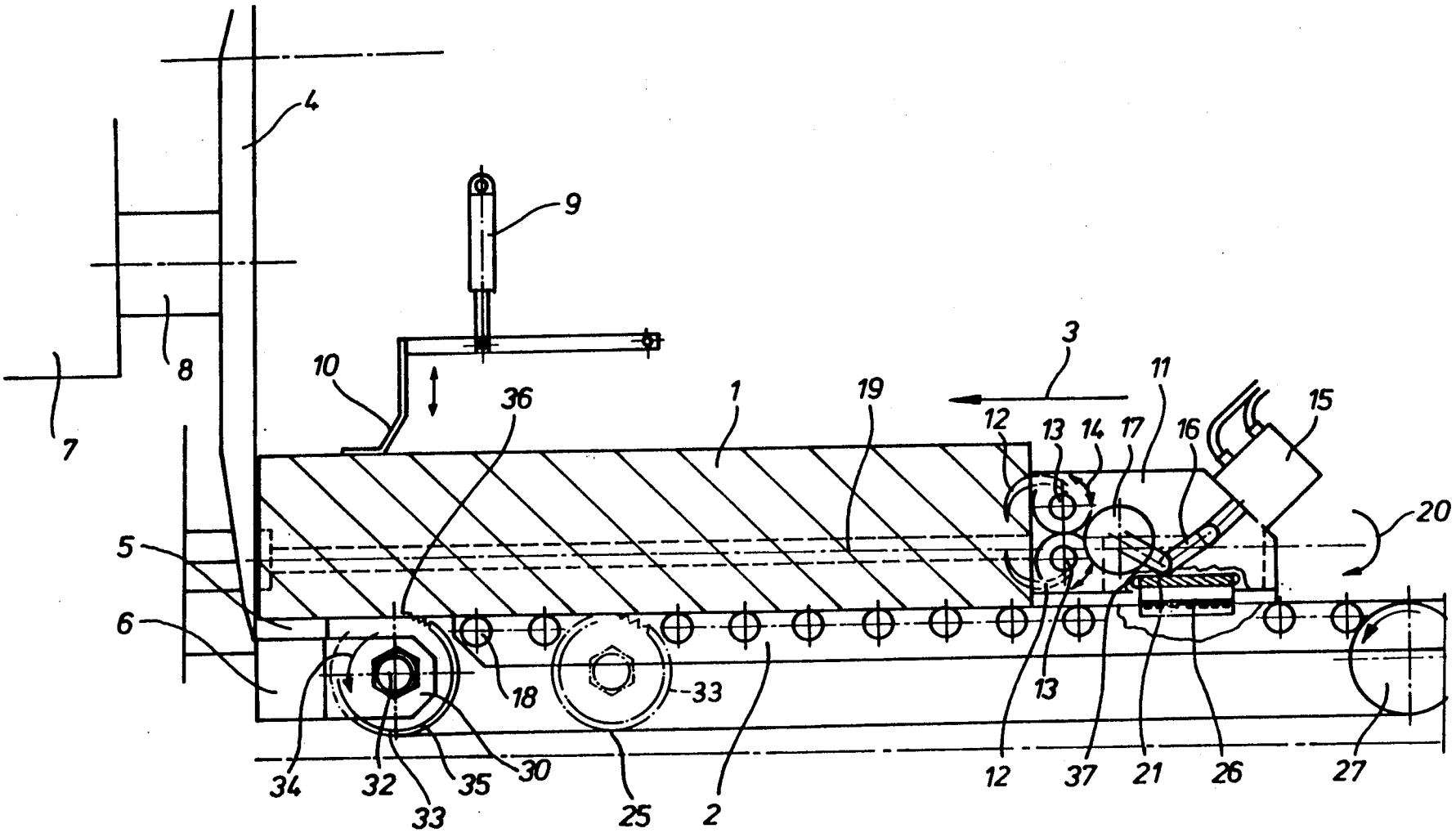
FIG. 1 shows a lateral view of a feed device in accordance with the invention.

The older patent DE 32 49 925 C2 of the same applicant is made reference herein in terms of the operation of the feed drive, the appearance of the claw and further details. The contents of said publication is to be an integral part in full of the present invention.

The product to be sliced is placed on a roller conveyor 2, which is slanted downward at an angle of 45° to the horizontal whereby the roller conveyor consists of individual rollers 18 which are parallel and can be rotated at reciprocal distance. The product 1 is brought with its front face against a circular knife 4 connected via a drive shaft 8 to cam 7 which gives the circular knife 4 an eccentric cutting motion.

To the circular knife 4 is assigned in a housing-locked manner a counterknife 5 situated on a knife girder 6, which is also housing-locked.

At its upper side the product may be pressed against the counterknife 5 with a clamp 10 whereby the required pressure is produced by a pneumatic cylinder 9.

The feed drive of the product 1 is effected by a so-called "claw 11" designed in essence as a drive housing whose inside features claws 12 on shafts 13 which are parallel to each other and superimposed on each other. In accordance with FIG. 1 each shaft 13 carries a series of claws 12 which are at a reciprocal distance from and parallel to each other whereby both shafts are engaged with each other via respective gears and are driven for their part in the direction of arrow 14 by a gear 17.

The gear 17 is driven through a connecting rod 16 loaded by a pneumatic cylinder 15.

Activation of the pneumatic cylinder 15 moves the connecting rod 16 thus turning the gear 17. When the gear 17 mates with at least one gear of a shaft 13, the shafts 14 are turned in one of the directions of the arrow 14 so that the claws 12 engage the rear face of the product 1 and thereby hold the product.

The feed drive of the claw 11 is the result of the fact that the entire claw 11 is placed on a claw track 21 which for its part is held in a bearing housing 22. The bearing housing 22 features linear bearings 23 so that the bearing housing 22 can be moved over these linear bearings 23 on a V-track 24 in the direction of feed (direction of arrow 3) or in the opposite direction.

In order to facilitate the exchange of the claw 11 on the claw track 21 the bottom of claw 11 features a recess 37 in accordance with FIG. 1 into which is introduced the claw track 21 and secured in a manner not shown here. This feature enables the claw 11 to be readily removed from the claw track 21.

This offers the advantage that the claw 11 is readily exchanged and cleaned.

Figure 2:
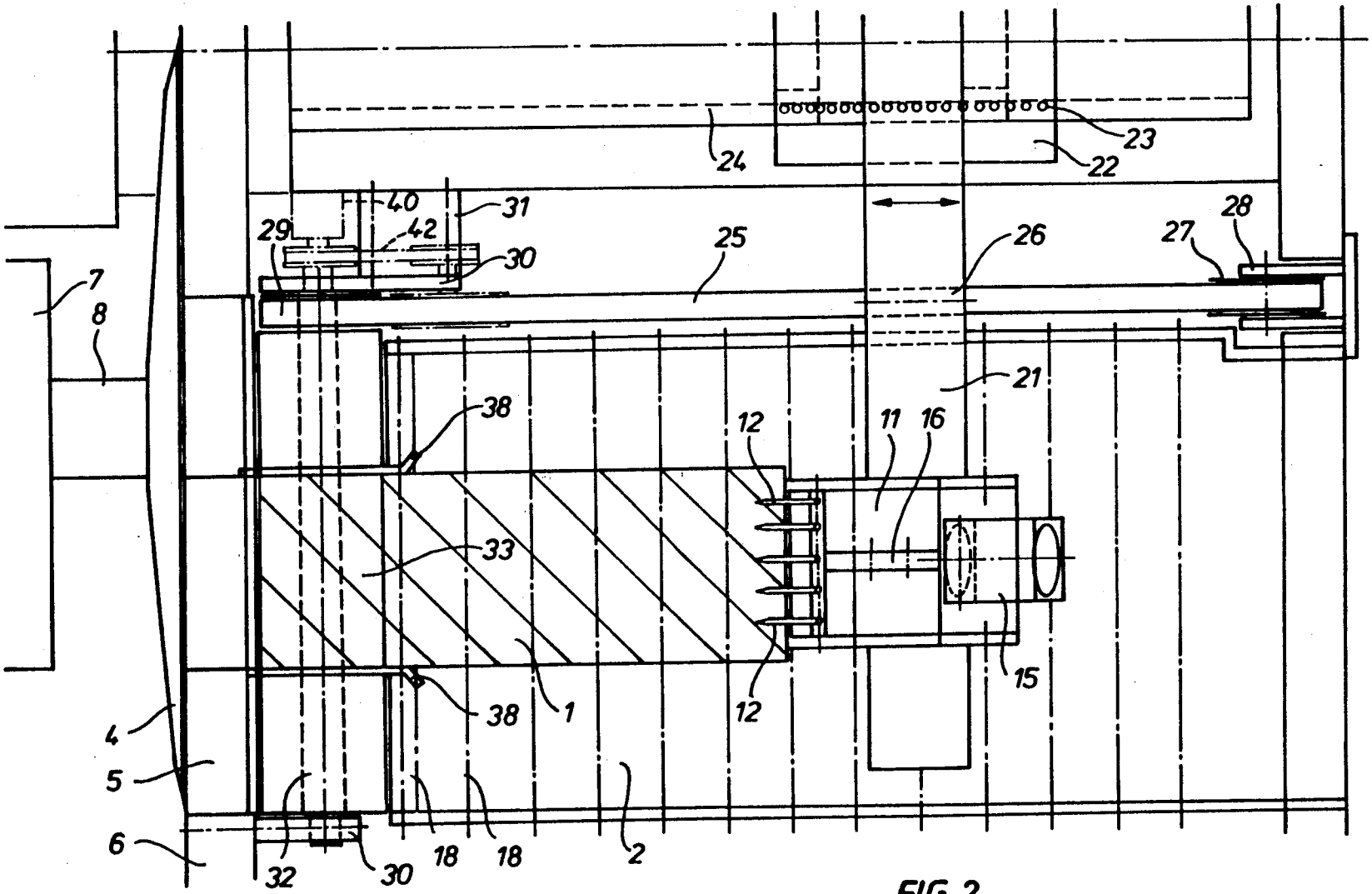
FIG. 2 shows a top view of the feed device in accordance with FIG. 1.

FIG. 1 only indicates and the drawing in FIG. 2 altogether misses the fact that the feed of the bearing 22 to which is attached the claw track 21 occurs through a ball spindle 19 whereby the ball spindle penetrates a spindle nut in the bearing housing 22 not shown here in greater detail and is driven intermittently by a rotary drive in the direction of the arrow 20.

In other words, through this drive, the claw 11 is driven intermittently in the direction of feed 3 so that an exactly defined feed occurs in the direction of the circular knife 4 and so that the circular knife cuts an exactly defined slice from product 1.

In accordance with the invention the front end of the product 1 is also driven by an additional feed device in the direction of the circular knife 4. In accordance with the preferred embodiment, the feed device consists of a feed roller 33 which features teeth 35 at its outer perimeter. These teeth 35 engage at least in part the bottom of the product 1. As illustrated in solid outline in FIG. 1, the feed roller 33 may be located in an intermediate area between an end of the roller conveyor and the circular knife. Alternatively, as illustrated in dotted outline in FIG. 1, the feed roller 33 may be arranged in the area of the roller conveyor between adjacent rollers.

The feed roller 33 can be rotated on an axis 32 whereby the drive gear 29 is coupled with the feed roller 33. The drive gear 29 is embraced by an endless ratchet belt 25 which on its other end runs over a rear guide roller 27. The guide roller can be rotated and is housed in a housing-locked holder 28.

The claw track 21 is clamped with and coupled to the upper or lower strand of the ratchet belt 25 through a clamp 26. As a result, the corresponding drive of the bearing housing 22 in the direction of feed 3 via the coupling of the claw track 21 with the ratchet belt 25 also drives the drive gear 29 which in turn is coupled with the feed roller 33. Instead of being driven by the same drive as the claw, the roller 33 may have its own drive 40 as illustrated in dotted outline in FIG. 2. The feed roller drive 40 is linked via pulley 42 to ratchet belt 25 to be driven in synchronism with the claw. In another alternative, the linkage between the claw drive and the feed roller may be eliminated by taking out belt 25 altogether, the feed roller then having no drive and acting only as a guide roller.

It is to be noted that the axis 32 is arranged on lateral base plates 30 whereby the base plates are secured to the housing with the possible interposition of a spacer block 31.

In addition, provisions may be made for the product to be directed also via side guides 38 resting sideways on the product 1.

Due to the force-locking coupling between the feed of the claw 11 and the rotation of the feed roller 33 no more swings are possible in the product in the area between the feed roller 33 and the claw 11 because this area is driven synchronously and exactly in the direction of feed. As a result the slice thickness of the cut product is absolutely uniform. This also ensures that the advance (feed motion) of the claw is not only introduced at the rear portion of the product but also affects the front portion of the product.

Within the context of this invention is also the arrangement whereby only the rear end of the product is driven in a force-locking and form-locking fashion. Such a guiding method consists, for example, of the fact that the active drive of the feed roller is removed and that the feed roller with its ratchets penetrates only passively the bottom of the product. This arrangement also produces a certain guidance of the product and a stabilization of the product mass in relation to the feed drive limited to the rear. Within the front area, outside the roller conveyor, where normally only a chute of sheet metal is present, the existing significant friction is reduced because in accordance with the invention the feed roller constitutes a corresponding pivot arrangement for the product.

Although preferred embodiments of the invention have been described above by way of example only, it will be understood by those skilled in the field that modifications may be made to the disclosed embodiments without departing from the scope of the invention, which is defined by the appended claims.

I claim:

1. Feed drive assembly for a cutting machine for cutting foods, the cutting machine having a roller conveyor on which a product to be sliced lies and is held at a rear end by a claw and a claw drive for driving the claw in a direction of feed and leading a front area of the product into a cutting range of the cutting machine, whereby, coupled with the claw drive, the feed drive assembly comprises at least one feed roller separate from the roller conveyor which engages a bottom of the product at the front area of the product in the vicinity of a circular knife in a force-locking and form-locking manner and which is driven in a rotating fashion as a function of a feed path of the claw; and coupling means for coupling the claw drive to both the claw and the feed roller in a form-locking fashion;

the form-locking coupling means comprising a circulating closed ratchet belt which embraces a drive gear connected with the feed roller and is guided over a guide roller whereby a claw track connected to the claw and driven in the direction of feed is connected with an upper strand of the ratchet belt via a clamp.

2. Feed drive assembly in accordance with claim 1 whereby the feed roller is arranged in an intermediate area between an end of the roller conveyor and the circular knife.

3. Feed drive assembly in accordance with claim 1 whereby the feed roller is arranged in the area of the roller conveyor and engages between the rollers of the roller conveyor.

4. Feed drive assembly in accordance with claim 1 whereby the outer perimeter of the feed roller features teeth consisting of uniformly distributed serrations at a reciprocal distance from one another and whose longitudinal axis extends perpendicularly to the direction of feed.

5. A cutting machine for cutting elongated products into slices, comprising:

undriven roller conveyor means for supporting a product to be sliced, the conveyor means having a forward end and a rear end;

cutter means adjacent the forward end of the conveyor means for cutting slices from a front end of the product;

first feed means for driving the product forwardly in a feed direction along the conveyor means into the cutting range of the cutter means, the first feed means comprising claw means for gripping a rear end of the product, and drive means for driving the claw means in the feed direction; and second feed means for guiding a forward portion of the product towards said cutter means in synchronism with the driving of the claw means, said second feed means being located adjacent said cutter means and comprising at least one feed roller separate from said roller conveyor means for engaging a bottom surface of the product in the vicinity of said cutter means in a force-locking and form-locking manner.

6. The machine as claimed in claim 5, wherein the cutter means comprises a circular knife directed transverse to the feed direction at the front end of the product and a counter knife located against the bottom surface of the product adjacent its front end.

7. The machine as claimed in claim 6, further including hold down means adjacent said cutter means for pressing down on an upper surface of the product to press the product down against the counter knife.

8. The machine as claimed in claim 5, wherein said drive means comprises a single drive means for driving both said claw means and said feed roller in synchronism.

9. A cutting machine for cutting elongated products into slices, comprising:

undriven roller conveyor means for supporting a product to be sliced, the conveyor means having a forward end and a rear end;

cutter means adjacent the forward end of the conveyor means for cutting slices from a front end of the product;

first feed means for driving the product forwardly in a feed direction along the conveyor means into the cutting range of the cutter means, the first feed means comprising claw means for gripping a rear end of the product;

second feed means for guiding a forward portion of the product towards said cutter means in synchronism with the driving of the claw means, said second feed means being located adjacent said cutter means and comprising at least one feed roller separate from said roller conveyor means for engaging a bottom surface of the product in the vicinity of said cutter means in a force-locking and form-locking manner; and a single drive assembly for driving said claw means and said feed roller in synchronism, said drive assembly comprising an endless belt drive extending between the rear end of said roller conveyor means and said feed roller and linked to said claw means and said feed roller, and drive means for driving said belt drive to drive said claw means in the feed direction and to simultaneously rotate said feed roller.

* * * * *